United States Patent [19]

Lenox et al.

[11] 4,452,604

[45] Jun. 5, 1984

[54] DECORATIVE SHEETS AND COVERINGS COMPRISING POLYVINYL CHLORIDE AND CATIONIC DYESTUFFS

[75] Inventors: Ronald S. Lenox, East Hempfield Township, Lancaster County; Anne L. Schwartz, West Hempfield Township, Lancaster County; Moses Sparks, Jr., Manheim Township, Lancaster County, all of Pa.

[73] Assignee: Armstrong World Industries, Inc., Lancaster, Pa.

[21] Appl. No.: 540,678

[22] Filed: Oct. 11, 1983

Related U.S. Application Data

[63] Continuation of Ser. No. 376,550, May 10, 1982, abandoned.

[51] Int. Cl.[3] ..... D06P 1/41; D06P 3/00; D06P 3/79; D06P 5/00

[52] U.S. Cl. ..... 8/471; 8/470; 8/508; 8/510; 8/561; 8/562; 8/654

[58] Field of Search ..... 8/470, 471, 508, 510, 8/561, 562, 654

[56] References Cited

U.S. PATENT DOCUMENTS

| | | | |
|---|---|---|---|
| 3,232,076 | 11/1980 | Stetson et al. | 428/207 |
| 3,473,881 | 10/1969 | Halleda . | |
| 3,922,445 | 11/1975 | Mizuno et al. | 8/467 |
| 3,969,071 | 7/1976 | Hugelin | 8/471 |
| 3,992,140 | 11/1976 | Psaar | 8/471 |
| 3,995,992 | 12/1976 | Defago et al. | 8/471 |
| 4,042,545 | 8/1977 | Defago et al. | 106/22 |
| 4,057,388 | 11/1977 | Defago et al. | 8/471 |
| 4,253,838 | 3/1981 | Mizuno et al. | 8/471 |
| 4,272,292 | 6/1981 | Mizuno et al. | 8/471 |
| 4,306,875 | 12/1981 | De Feo et al. | 8/471 |

*Primary Examiner*—Maria Parrish Tungol
*Attorney, Agent, or Firm*—Laird F. Miller

[57] ABSTRACT

The present invention concerns our discovery that decorative sheets and coverings comprising polyvinyl chloride and having substantially non-migratable through-color images may be prepared using cationic dyestuffs. These coverings may be prepared by providing a variety of polyvinyl chloride-containing substrates with image compositions comprising cationic dyestuffs and a suitable binder, and then treating these materials such that the cationic dyestuffs migrate into the substrate. Through-color images are obtained which are substantially non-migrating, even under severe conditions.

47 Claims, No Drawings

DECORATIVE SHEETS AND COVERINGS COMPRISING POLYVINYL CHLORIDE AND CATIONIC DYESTUFFS

This is a continuation of copending application Ser. No. 376,550, filed May 10, 1982, now abandoned.

The present invention relates to decorative sheets and coverings and more particularly to decorative sheets and coverings comprising polyvinyl chloride and cationic dyestuffs.

BACKGROUND OF THE INVENTION

Substrates comprising polyvinyl chloride have come into wide use as decorative coverings and particularly as decorative floor coverings. In order for such materials to be aesthetically acceptable, they must be provided with a colored pattern or design. Two general types of colorants have traditionally been available to provide such patterns; namely, dyes and pigments. The *Encyclopedia of PVC* defines dyes to be colorants that are soluble in vinyl formulations, whereas pigments are colorants that are insoluble in vinyl formulations. Dyes have primarily comprised disperse and solvent dyes; however, such dyes have been shown to have definite drawbacks which preclude their use in polyvinyl chloride systems. Thus, although they may be conveniently used in polyvinyl chloride-containing formulations to give products that have good transparency and color strength, problems associated with color bleeding, poor light fastness, lack of heat stability and the like have mitigated against their use and have resulted in the general adoption of pigments to provide color to polyvinyl chloride compositions.

Pigments are conventionally applied by means of printing inks, or by stencil deposition of pigmented particles. Nevertheless, pigmented products are not entirely satisfactory because, for example, the color selected is limited and through-color images cannot be obtained. Accordingly, industrial producers of products containing polyvinyl chloride have long sought ways to improve the color characteristics of such products.

THE PRIOR ART

Recently, Stetson et al., in U.S. Pat. No. 4,232,076, disclosed processes for obtaining through-color penetration of plasticized polyvinyl chloride substrates by transfer printing using sublimable disperse dyes. These processes comprised the steps of applying a transfer paper or other release surface coated with a pattern or design comprising a sublimable disperse dye to the surface of a polyvinyl chloride substrate. When the composite was heated, the dye sublimed into the substrate. The transfer paper was then removed leaving a substrate with a sharp, through-color image.

One stated advantage of flooring structures prepared in this fashion was the distinctiveness of detail which allegedly remained during the service life of the floor covering. It has been found, however, that when vinyl floor structures comprising a sublimable disperse dye are subjected to heat, migration of color and loss of pattern definition can be accelerated.

Accordingly, one objective of the present invention is to provide processes for preparing substrates comprising polyvinyl chloride whereby said substrates have a through-color image which will not fade or bleed with time or when exposed to high temperatures.

Yet another objective of the present invention is to provide decorative sheets and coverings having through-color images, said sheets and coverings being usable as flooring materials, wall coverings, and the like.

Still yet another objective of the present invention is to provide transfer sheets and ink compositions comprising cationic dyestuffs which will be useful to prepare decorative surfaces comprising polyvinyl chloride.

These and other objectives of the present invention will become apparent from the detailed description of preferred embodiments which follows.

SUMMARY OF THE INVENTION

The present invention concerns our discovery that decorative sheets and coverings comprising polyvinyl chloride and having substantially non-migratable through-color images may be prepared using cationic dyestuffs. These coverings may be prepared by providing a variety of polyvinyl chloride-containing substrates with image compositions comprising cationic dyestuffs and a suitable binder, and then treating these materials such that the cationic dyestuffs migrate into the substrate. Through-color images are obtained which are substantially non-migrating, even under severe conditions.

DETAILED DESCRIPTION OF PREFERRED EMBODIMENTS

In one embodiment the present invention comprises a process for preparing a decorative sheet comprising polyvinyl chloride and a substantially non-migratable image, said process comprising the steps of selecting a substrate comprising polyvinyl chloride; interfacing an image composition with said substrate, said image composition comprising at least one cationic dyestuff and a binder; and heating said interfaced substrate and image composition to migrate said dyestuff into said substrate, said binder being of a type which will not substantially impede migration of said dyestuff.

In a second embodiment the present invention comprises a decorative sheet comprising polyvinyl chloride and a substantially non-migratable image comprising at least one cationic dyestuff.

In a third embodiment the present invention comprises a decorative floor covering comprising a backing and a substrate comprising polyvinyl chloride adhered to said backing, said substrate comprising a substantially non-migratable image comprising at least one cationic dyestuff.

In a fourth embodiment the present invention comprises an image composition adaptable to provide a substantially non-migratable through-color image for a substrate comprising polyvinyl chloride when interfaced with said substrate and heated, said image composition comprising at least one cationic dyestuff and a binder which will not substantially impede migration of said dyestuff.

Basic dyes have long been of interest for dyeing various substrates, particularly fibrous textile substrates. Conventionally, these dyes were employed in dye baths in which the substrates were immersed. However, with the advent of transfer printing as a useful application technique for disperse dyes, many attempts were made to apply the same technology to basic dyestuffs. Basic dyes differ from disperse dyes because, as a general rule, they do not sublime at atmospheric pressure and, even under reduced pressure, they sublime only slightly.

Therefore, difficulties were encountered relating to the proclivity to thermal degradation shown by many basic dyes. These problems, combined with the generally lower melting points of basic dyes, virtually precluded their use for transfer printing. Therefore, substantial effort was expended to find ways to overcome these problems.

As a result of these efforts, numerous additives or dye treatments were proposed which purported to overcome the relative non-transferability of the basic dyes, thereby making them useful to print fibrous materials. For example, U.S. Pat. No. 3,922,445, which is one of a series of patents that issued to Mizuno et al., disclosed that the incorporation of oxidizing agents into transfer printing inks enabled otherwise poorly transferable basic dyestuffs to be transfer printed. A similar result was reported in U.S. Pat. No. 3,969,071 in which a material that chemically altered the dyestuff was included in the printing ink. In U.S. Pat. No. 3,992,140, carbinol bases of basic dyestuffs were used, as they were in U.S. Pat. Nos. 3,999,939 and 4,040,779. Other approaches were also disclosed in U.S. Pat. Nos. 3,995,992; 4,057,388; 4,137,042; 4,253,838; and 4,306,875.

The aforementioned transfer printing techniques, which are applicable to basic and disperse dyes, are essentially directed to the printing of synthetic fibers, such as polyesters, acrylics, nylons and acetates. These materials readily permit the migration of dyes through the fiber matrix, presumably due to the high surface-area-to-volume ratio of the fibers. Conversely, sheet products present a different situation because they have a low surface-area-to-volume ratio, which tends to impede migration. The usual way to improve migration in such circumstances is by raising the temperature settings; however, this can lead to destruction of the dyes and ca also damage the sheet material itself. Accordingly, it was surprising and unexpected to find that basic dyes in their cationic form could be induced to migrate into substrates comprising polyvinyl chloride without the use of migration enhancers, and that the resulting dyed substrates retained sharp images over long periods of time and when subjected to strong heating. These results are especially surprising in view of our finding that the process of the present invention gives poor results with polyesters, acrylics, urethanes, nylons and epoxy materials.

The term "cationic dye" as used herein to define the present invention comprises basic dyes which are in their cationic form, and we have found that virtually any such dye may be used in conjunction with the present invention. Hundreds of these dyes are in existence, many of which are found in *The Colour Index* published by The Society of Dyers and Colourists in association with the American Association of Textile Chemists and Colorists. We have discovered, however, that superior results may be obtained if the ionic charge on the cationic dye is delocalized. Thus, methine dyes, triphenylmethane dyes, xanthene dyes, cyanine dyes and the like give more vivid colors than do simple cationic dyes having localized ionic charges.

The present invention is applicable to a wide variety of fibrous or sheet substrates derived from vinyl chloride. Homopolymeric vinyl chloride substrates are preferred, although copolymers with vinylidene chloride, vinyl acetate, acrylic acid or other polymerizable materials also give good results. Most vinyl chloride-containing copolymers that are in use today contain at least 70% vinyl chloride. For convenience, the term "polyvinyl chloride" as used herein to define various applicable substrates will be deemed to include copolymers of vinyl chloride with other monomers.

Polymeric materials derived from vinyl chloride monomer are essential because, as noted above, poor results are obtained with non-vinyl chloride-containing materials that are known to be transfer printable with cationic dyestuffs in the presence of migration-encouraging compounds, such as the oxidizing agents of Mizuno et al. While applicants do not wish to be bound by any particular theory of operability, it appears that cationic dyes have a particular affinity for polyvinyl chloride such that, when the dyes migrate by sublimation or otherwise into a substrate comprising polyvinyl chloride, they interact with the polyvinyl chloride and become essentially non-migratable. Thus, even when subjected to solvents or prolonged, severe heat conditions, patterns prepared according to the present invention remain sharp and clear.

The physical character of the polyvinyl chloride-containing substrate does not appear to be particularly significant. Suitable through-color images have been obtained by interfacing an image composition with gelled and ungelled plastisols (with or without chemical blowing agents), sintered dryblend resins, fused plastisols, and plasticized or unplasticized polyvinyl chloride film. In addition, it has been found that saran film, or like films which are copolymers of polyvinyl chloride, can be similarly treated. The substrates may also comprise other common additives such as heat and light stabilizers, blowing agents, fire retardants, and the like, which are compatible with the objectives of the present invention.

When heated, the cationic dyes in the image composition migrate into these substrates to give substantially non-migratable through-color images. Of importance, however, is the fact that cationic dyes treated as described herein will maintain a color shade which remains essentially true throughout the dyeing process. Thus, the present invention is decidedly superior to those prior art processes employing cationic dyestuffs in which the dyestuffs are treated such that they temporarily change or lose color.

Despite these advantages, care must be taken in selecting the substrates which will be dyed according to the present invention. It has been observed that the inclusion in a substrate of certain materials that have an affinity for cationic dyes, such as limestone or silica fillers, may impede migration. Therefore, use of such materials should be avoided where good depth of penetration is desired.

The cationic dyestuffs of the present invention will be applied in combination with a binder that does not interfere with the subsequent migration of the dyestuff into the substrate. Certain binders, such as polyvinyl alcohol or polyvinyl acetate will cause this interference or impedence. Accordingly, a binder should be selected which does not cause this effect. Examples of binders which have given superior results are polyvinyl acetals, such as polyvinyl butyral; cellulose ethers, such as ethyl cellulose and methyl cellulose; and mixtures thereof. Compositions comprising the cationic dyes and binders of the present invention will be referred to herein as "image compositions."

Image compositions may be applied to or interfaced with various surfaces by virtually any technique, such as transfer printing, conventional printing using rotogravure, flexographic, lithographic, screen, ink jet and other printing processes, hand application techniques such as those used by an artist, powder dispersion techniques and the like. For convenience, the method of applying an image composition will be referred to herein as "imaging," and the exposure of a substrate to an image composition will be referred to as "interfacing."

An especially preferred method of migrating an image into polyvinyl chloride-containing substrates is by transfer printing. Transfer printing basically comprises the steps of imaging a transfer sheet, interfacing the sheet with the substrate such that the image is in contact, but preferably in intimate contact, with the substrate, and then applying heat to transfer the image.

A variety of transfer sheets are commercially available, and many of these are suitable to practice the present invention. Care must be taken in selecting an appropriate sheet, however, because certain sheets will become strongly adhered to the surface of the substrate during the transfer printing process. Consequently, even though a suitable image transfer may occur, adhesion of the transfer paper to the substrate may prevent a desirable product from being prepared. Especially good results have been obtained using foil or polyester transfer sheets; however, the most satisfactory results have been obtained using clay-coated kraft paper comprising a coating material between the clay coating and the image to facilitate release of the transfer sheet from the hot substrate. An example of such a coated transfer sheet is Frankote Cover Bristol, a commercially available kaolin clay-coated white kraft paper, which has been coated with a 1–3 mil layer of polyvinyl alcohol, ethyl cellulose or methyl cellulose prior to use. These coated transfer papers also provide an exceptionally smooth surface for the image, as well as excellent contact of the image with the substrate. Furthermore, they have shown a remarkable ability to give immediate release from a hot (about 300° F.) vinyl substrate without causing picking, pitting or other damage to the substrate.

Once the paper has been prepared, it is imaged by virtually any technique, such as those set forth above. With transfer printing, it is preferable that the binder cause the image composition to remain adhered to the transfer sheet when the latter is separated from the substrate. Although image compositions which adhere, in whole or in part, to the surface of the substrate may also have utility, they are not preferred because they usually must either be removed at a later stage in the process, or be protected with a wear layer. It has been found that image compositions comprising the preferred binders set forth above also possess this desired attribute.

When a dry powder is imaged to a transfer sheet, it will usually be applied as a pattern which preferably is then warmed to cause the binder to adhere to the sheet. Transfer sheets may be prepared in which the image composition is not adhered; however, they often lead to products having smeared images and, thus, are not preferred.

When the image compositions are applied as inks, the inks will usually comprise one or more solvents for the dye and binder. A wide variety of solvents have utility when incorporated into printable cationic dye systems. Examples of these may be found in U.S. Pat. No. 4,272,292, another of the Mizuno et al. references. It is noted, however, that this reference places certain restrictions on the proportions of solvents which may be used due to stability problems associated with the carbinol bases disclosed therein. No such restrictions apply to the present invention and virtually any desired solvent may be used. Preferably, but not necessarily, the solvent or solvents that are selected will be suitable to solubilize essentially all of the binder and dyestuff in order to obtain a uniform printing composition. These compositions may also contain other compatible components, such as drying agents, hardening agents, emulsifiers, dispersants, thickeners, fillers and the like, all of which are well known in the art and which will be soluble or dispersable in the selected solvent system.

It has been observed that ink compositions of the present invention may be used without difficulty when they are freshly prepared. Upon standing for several hour, however, a gelling reaction occurs which interferes with the applicability of the ink. The reason for the gelling is not apparent although it is believed to be due to an interaction of the dyestuff with the binder; nevertheless, gelling normally does not affect dye color.

We have found that the ink may be stabilized against gellation by including an appropriate basic stabilizer in the ink, provided that the basic material does not substantially change the color of the dye, either immediately, or on long standing. Amines, and particularly tertiary amines, have provided good results. One such tertiary amine is N,N,N′,N′-tetramethylethylene diamine. This compound has given especially good results when included in the ink at levels of about 1 to about 5 percent of the total weight of the ink. The amount of amine used is not critical, although if too much is used, precipitation of the binder may occur.

Amines and bases have been used by others in formulating various cationic dye-containing compositions; however, the purposes for including these bases were entirely different. For example, Mizuno et al., in U.S. Pat. No. 4,272,292, used strong bases to prevent long-term decomposition of the carbinol bases of the cationic dyes disclosed therein. As another example, Defago et al., in U.S. Pat. No. 4,042,545, disclosed a system in which organic or inorganic acid acceptors were used to free the cationic dyes from their salt form. These acid acceptors, which included amines, caused a color change or a loss of color, and the invention disclosed by Defago et al. taught the addition of an indicator dye so that this drawback could be circumvented. Thus, the bases disclosed by Mizuno et al. and Defago et al. were required for the operability of their respective inventions.

The use of the stabilizing bases disclosed herein is purely optional. The cationic dyes maintain essentially a true color throughout the processes of the present invention and these colors remain constant in the presence or absence of a stabilizer. Therefore, virtually any basic stabilizer may be used to practice the present invention, provided that it stabilizes the ink composition without causing a significant change in color. Nevertheless, amines, and particularly tertiary amines, are the preferred stabilizers.

Three major factors appear to contribute to the depth of color penetration into substrates suitable to practice the present invention. These are the nature of the ionic charge on the cationic dyestuff, the temperature during migration of the image into the substrate, and the length of time during which the temperature is applied. In addition, three other factors may be considered, these being the pressure that is applied, the amount of dyestuff available to migrate and the color type of the dyestuff.

Appropriate inks may be applied to the transfer paper by any of the techniques referred to above. The ink is allowed to dry and the transfer sheet is interfaced with the substrate such that the image is in contact with the substrate. The interfaced materials are then subjected to heat and perhaps pressure for a period of time. The temperature and the residence time of the interfaced materials at that temperature are probably the two most important variables, the pressure being needed primarily to maintain good contact between the substrate and the image to be transferred. Suitable temperatures and residence times range from about 180° to about 380° F. for from about 1 to about 300 seconds. Preferred ranges are from about 270° to about 350° F. for from about 1 to about 100 seconds, whereas most preferred ranges are from about 290° to about 320° F. for from about 30 to about 90 seconds. Pressures of from 0 to about 500 pounds per square inch may be used although pressures of from about 10 to about 50 pounds per square inch are preferred.

The best penetration is obtained using transfer printing. For example, when a fused polyvinyl chloride plastisol sheet is subjected to moderate conditions, such as 310° F. for 30 seconds, penetrations of about 3 to 5 mils are usually obtained, whereas, under more severe conditions, penetrations of about 8 to 10 mils can be obtained. Furthermore, if increased amounts of cationic dyes are used, penetrations of as much as perhaps 20 mils may be obtained. Nevertheless, increased levels of dyestuff cause loss of pattern definition and should be avoided.

It is generally known that dye penetration may also depend to a certain extent on dye color. For example, experiments conducted using red, black, blue and yellow dyestuffs at different temperatures for various times on a fused 30-mil thick plastisol showed varied results. When different samples comprising these dyes were heated for 60 seconds at 260° F. and at 310° F., the red, black and blue dyes penetrated to a certain depth and stopped, whereas the yellow dye continued to penetrate until heating was stopped. At 350° F., the red and black dyestuffs showed deeper penetration when the time of exposure was increased from 60 to 120 seconds, whereas the blue dyestuff showed no further penetration. As before, the yellow dyestuff showed continued penetration with continued heating, although it, too, eventually ceased migrating. For these reasons, the migration characteristics of each individual dye should be considered by the artisan when practicing the present invention.

Aside from the good depth of penetration available through the use of transfer printing as opposed to direct printing, another advantage is the sharp pattern definition and clarity of color which may be obtained. The reason for this appears to be due to the manner in which migration occurs. Presumably the dyestuff migrates as individual molecules from the transfer sheet into the matrix of the substrate where it becomes essentially non-migratable. The process occurs in conformity with the pattern that has been selected; thus, through-color images having very sharp definition are possible. Furthermore, as discussed in more detail below, the apparent molecular migration and attachment process may also account for the stability of these products even when exposed to prolonged heating or solvents.

The color fastness of the various through-color transfer-printed products was evaluated in a number of ways. One method involved the subjection of samples, such as fused polyvinyl chloride sheets which had been transfer printed with a wood grain pattern, to thermal stability tests at 158° F. and 180° F. for six weeks. No color migration or color change was observed during this time period and the dye colors also remained bright and unfaded.

A second method of testing stability involved the subjection of samples of several substrates dyed with different colors to various solvents, such as isopropyl alcohol, 5% acetic acid, 5% sodium hydroxide, 5% sulfuric acid, beef tallow, ASTM #1 oil, or cottonseed oil. No extraction of color was observed, even after 46 hours of testing. Furthermore, no crocking was observed when ethyl alcohol or water laden cloths were rubbed over the surfaces of the samples.

A third test involved the subjection of several samples to a xenon fadeometer test, a severe test which measures the fading of the color when a sample is exposed to a xenon lamp for at least 100 hours. The test indicated that samples of transfer printed polyvinyl chloride containing a plastisol had reasonably good color stability even after 100 hours. As a basis for comparison, cationic dyes in hydrophilic polymer systems such as cotton or nylon are known to have relatively poor color stability under these conditions.

In addition to transfer printing, imaging may also be achieved by interfacing the image composition with the substrate by applying the image composition directly on the surface of the substrate. Alternatively, a support surface may be imaged and then interfaced with a later-applied substrate into which the dye will migrate. Any of the application techniques previously described may be used. If printing inks are used, the solvent is evaporated and the substrate bearing the design is heated as previously described. Nevertheless, although through-color images may be obtained by such direct application techniques, product quality is often not as satisfactory because the images normally are not as sharp or as deep as those obtained by transfer printing. This may be illustrated as follows.

When directly printed samples were heated at temperatures ranging from 270° to 370° F. for 30 seconds to 2 minutes, and then subjected to wet and dry crocking tests, variable results were obtained. Under the less stringent conditions, severe crocking and poor penetration were observed whereas generally good to very good results were observed after heating for the full two-minute period at 370° F. Nevertheless, pattern definition was not as good for these samples as it was for transfer printed samples. While applicants herein again do not wish to be bound by any theory of operability, it is believed that this is due to the presence of microscopic particles of dye in the image composition residing on the surface of the substrate or the underlying support. Each of these particles can serve as a source from which the individual dye molecules can migrate in all directions when heated. Thus, because the image composition remains in contact with the substrate during heat aging, dye molecules can continue to migrate from these particles, causing a fuzziness of pattern. Eventually these molecules also interact with the polyvinyl chloride, as suggested earlier, and become essentially fixed in place.

A variety of uses are envisaged for the products and processes of the present invention. Accordingly, products such as wall coverings, floor coverings, decorative films and windows, picture frames, toys, or virtually any substance comprising a polyvinyl chloride substrate in its structure or as a component may be provided with a sharp, long-lasting image according to this invention. Furthermore, a wide range of applications is envisaged within each area of application. Floor coverings provide a particularly good illustration of this diversity. Thus, floor structures comprising a backing coated with a fused or gelled polyvinyl chloride-containing plastisol can be transfer printed or directly printed and treated to give a through-color image. Alternatively, the flooring can be constructed by sequentially applying to a backing a plurality of individually dyed polyvinyl chloride-containing layers, thereby giving a three-dimensional color effect. As yet another alternative, a transfer sheet of the present invention can have a polyvinyl chloride-containing substrate applied to it in order to provide the substrate with a transferred, through-color image. This substrate could then be used as a wear layer which is subsequently adhered to a floor structure.

A further advantage resides in the light-stability of these cationic dye-containing products. As an example, it is possible to apply a UV or visible light-curable wear layer to a through-color composition because the curing process will normally have essentially no effect on the color of the cationic dyes contained in the composition.

The foregoing are provided merely to illustrate, but not to limit, the scope of the present invention. However, to provide further insight into the advantages and utilities of the present invention the following additional examples are presented.

EXAMPLES

The plastisol used in the following examples was comprised of the following components:

| Ingredient | Parts by Weight |
|---|---|
| Dispersion grade PVC resin | 100 |
| Dioctyl phthalate plasticizer | 25 |
| 2,2,4-Trimethyl-1,3-pentanediol diisobutyrate ester plasticizer | 15 |
| Stabilizer | 2 |

Where indicated, the plastisol was coated at various thicknesses on a standard permanent floor backing and fused at about 375° F. for 3–5 minutes. Plastisols of this type are referred to herein as "backed fused plastisols." Samples were also prepared by drawing down coatings of the plastisol on a glass plate, similarly fusing them, and removing the resulting film from the plate. Plastisols of this type are referred to herein as "clear fused plastisols."

EXAMPLES I–IV

Examples I–IV illustrate the transfer printing of clear fused plastisols with various dyes at various temperatures to measure dye penetration. Transfer printing was achieved using a Frankote Cover Bristol transfer sheet that had previously been coated with 12–15% aqueous polyvinyl alcohol to give a 1–3 mil dry coating. Two ink bases were prepared as follows:

| Ingredient | Parts by Weight | |
|---|---|---|
| | Ink Base A | Ink Base B |
| Polyvinyl butyral binder | 9.1 | 4.4 |
| Ethyl cellulose binder | — | 4.4 |
| Xylene | 66.9 | 68.3 |
| 1-Butanol | 22.5 | 22.9 |
| N,N,N',N'—Tetramethylethylene diamine | 1.5 | — |

Example I comprised 6 parts of Basic Yellow 13 dye for every 100 parts of Ink Base A; Example II comprised 6 parts of Basic Blue 26 dye for every 100 parts of Ink Base A; Example III comprised 6.2 parts of Basic Red 12 dye for every 100 parts of Ink Base B; and Example IV comprised 6.2 parts of Maxilon Super Black OLN dye for every 100 parts of Ink Base B. The inks of Examples I and II were found to be stable for weeks, whereas the inks of Examples III and IV, which contained no stabilizer, gelled after a few hours.

Each of the above inks was rotogravure-printed onto the transfer paper described above, which was then used to transfer print pieces of clear fused plastisol under the conditions listed below. The depth of penetration was measured microscopically. The pressure applied to each sample was about 10–20 pounds per square inch.

| Example | Time (seconds) | Dye Penetration in Mils | | |
|---|---|---|---|---|
| | | 260° F. | 310° F. | 350° F. |
| I (Basic Yellow 13) | 10 | 1.0 | 2.0 | 2.0 |
| | 20 | 1.4 | 2.6 | 2.0 |
| | 30 | 1.4 | 3.3 | 2.6 |
| | 45 | 1.4 | 3.6 | 4.0 |
| | 60 | 1.7 | 4.0 | 5.3 |
| | 120 | 2.3 | 8.0 | 7.0 |
| II (Basic Blue 26) | 10 | 0.5 | 1.3 | 1.0 |
| | 20 | 0.7 | 1.3 | 1.5 |
| | 30 | 1.0 | 2.6 | 2.0 |
| | 45 | 1.3 | 2.6 | 3.3 |
| | 60 | 1.3 | 3.3 | 5.0 |
| | 120 | 2.4 | 4.0 | 5.0 |
| III (Basic Red 12) | 10 | 0.7 | 2.0 | 1.3 |
| | 20 | 0.7 | 2.5 | 1.3 |
| | 30 | 1.0 | 2.5 | 2.7 |
| | 45 | 1.0 | 2.5 | 2.7 |
| | 60 | 2.0 | 2.5 | 4.0 |
| | 120 | 2.0 | 3.3 | 6.0 |
| IV (Maxilon Black OLN) | 10 | 0.7 | 1.3 | 1.3 |
| | 20 | 0.7 | 2.0 | 1.3 |
| | 30 | 1.0 | 3.3 | 2.0 |
| | 45 | 1.4 | 3.3 | 2.7 |
| | 60 | 1.4 | 3.3 | 4.0 |
| | 120 | 2.0 | 4.0 | 6.6 |

For comparative purposes, samples of Mylar® polyester film were transfer printed with the same image compositions. Virtually no coloration of the film occurred, other than a faint coloration of the surface. This coloration was readily removed by wiping with a dry cloth.

EXAMPLES V–VIII

These examples illustrate the types of results that may be obtained if substrates are directly printed with compositions comprising a cationic dye, and then heated to migrate the dye. In Examples V through VIII, backed fused plastisol pieces having a plastisol layer about 30 mils thick were directly printed with the ink compositions of Examples I, II, III and IV, respectively. The samples were placed in a forced air oven at temperatures of 270° or 370° F. for times ranging from 30 to 120 seconds. After each sample had cooled, it was checked for wet and dry crocking and the depth of penetration was measured. Dry crocking was measured by using a white cloth and rubbing vigorously; wet crocking was measured by similarly rubbing with room temperature solutions of water or a laboratory cleaning solution containing ammonia and an anionic surfactant. The cloth in each case was examined for any color which might have been removed, and the sample was examined for any change in appearance. The following results were obtained.

| | | Depth of Penetration (mils) & Crocking | | | | | |
|---|---|---|---|---|---|---|---|
| | | 270° F. | | | 370° F. | | |
| | Time | Crocking | | | Crocking | | |
| Example | (seconds) | Wet | Dry | Mils | Wet | Dry | Mils |
| V (Basic Yellow 13) | 30 | s | s | <0.5 | p | p | 1.0 |
| | 60 | s | s | 0.5 | g | p | 2.0 |
| | 90 | p | s | 0.5 | vg | p | 2.5 |
| | 120 | s | s | 1.5 | vg | g | 6.0 |
| VI (Basic Blue 26) | 30 | s | s | <0.5 | vg | p | <0.5 |
| | 60 | s | s | <0.5 | vg | p | 1.5 |
| | 90 | p | s | 0.5 | vg | p | 2.0 |
| | 120 | g | s | 0.5 | vg | g | 3.0 |
| VII (Basic Red 12) | 30 | s | s | <0.5 | s | p | 0.5 |
| | 60 | s | s | <0.5 | s | p | 0.5 |
| | 90 | s | s | 0.5 | vg | g | 2.0 |
| | 120 | s | s | 0.5 | vg | g | 3.0 |
| VIII (Maxilon Black OLN) | 30 | s | s | <0.5 | p | p | <0.5 |
| | 60 | s | s | <0.5 | s | p | 1.0 |
| | 90 | s | p | 0.5 | p | g | 2.0 |
| | 120 | s | p | 0.5 | vg | g | 2.0 |

KEY:
vg = very good = trace of color removed; no difference in sample appearance.
g = good = significant color removed; slight difference in sample appearance.
p = poor = much color removed; sample appeared light where rubbed.
s = severe = ink totally removed; sample appeared pale where rubbed.

EXAMPLE IX

This example illustrates the heat stability of color patterns produced according to the present invention. These samples were prepared utilizing three ink compositions containing about 100 parts of Ink Base B and about 6 parts of Basic Blue 26, Basic Red 12 or Basic Yellow 11, respectively. The respective inks were rotogravure printed onto transfer sheets, as described for Examples I–IV, which were then used to individually transfer print different samples of backed fused plastisol at 300° F. for 60 seconds under a pressure of 10 psi. The individual samples were placed in an oven at 158° F. for six weeks, during which time they were examined for color fastness. Essentially no loss of pattern definition or color fading was detected.

A comparative sample of a backed fused plastisol transfer printed with a disperse dye pattern was prepared as follows. A commercially available transfer paper printed with a geometric design was obtained from Sublistatic Corporation of America. This paper was interfaced with a sample of backed fused plastisol which was then transfer printed to give a through-color pattern comprising several colors, including yellow, red, orange, green and purple.

The printed sample was placed in an oven at 158° F. and changes were apparent after four days. These changes included blurring of the pattern edges and merging of the colors into one another to give new color combinations. After six weeks the pattern had markedly degraded and several of the colors had faded significantly.

EXAMPLES X–XIV

These examples illustrate the stability of through-color images obtained when backed fused plastisol samples comprising such images and prepared according to the present invention were treated with various solvents according to Paragraph 4.4.1 of Federal Specification L-F-001641 (GSA-FSS) dated Sept. 8, 1971, which pertains to the chemical and oil resistance of vinyl floor coverings with backing. Five separate samples were transfer printed as described in Examples I–IV using a transfer paper imprinted with about 6 parts of dye for every 100 parts of Ink Base B. As illustrated, the various solvents had no effect (NE) on any of the samples after 46 hours at room temperature.

| | Example No. and Colour Index Designation | | | | |
|---|---|---|---|---|---|
| Solvent | X Basic Red 1 | XI Basic Red 12 | XII Basic Red 46 | XIII Basic Green 4 | XIV Basic Yellow 11 |
| Isopropyl Alcohol | NE | NE | NE | NE | NE |
| 5% Acetic Acid | NE | NE | NE | NE | NE |
| 5% Sodium Hydroxide | NE | NE | NE | NE | NE |
| 5% Sulfuric Acid | NE | NE | NE | NE | NE |
| Beef Tallow | — | NE | — | — | — |
| ASTM #1 Mineral Oil | — | NE | — | — | — |
| Cottonseed Oil | — | NE | — | — | — |

EXAMPLE XV

This example illustrates the preparation of a sample having a layered or three-dimensional image. A standard permanent backing material of a type conventionally used in flooring structures was directly imprinted with a design according to the procedure described in Examples V–VIII. An ink was used which contained about 6 parts by weight of Basic Yellow 13 dye for every 100 parts of Ink Base B. After the solvent had evaporated, the backing was coated with a 10-mil layer of plastisol which was fused at 375° F. for 3 minutes in the absence of pressure. This caused the dye to migrate upwardly into the plastisol. When the plastisol had cooled, it was transfer printed at 300° F. for 60 seconds under a pressure of 10 psi using a transfer paper imprinted with an image composition containing about 6 parts of Basic Blue 26 dye for every 100 parts of Ink Base B. The resulting structure had an upper blue layer and a lower yellow layer, thus giving a three-dimensional effect.

EXAMPLE XVI

Example XVI illustrates the application of a transfer printed design to a polyvinyl chloride-containing tile base. A tile base comprising 37 parts of a vinyl chloride-vinyl acetate copolymer resin, 5 parts of a hydrocarbon resin, 14.5 parts of plasticizer, 2.4 parts of stabilizer, 235.1 parts of limestone and 6 parts of fiber was prepared and transfer printed using the Frankote paper described for Examples I–IV. The transfer sheet had been rotogravure printed with a Basic Yellow 13 ink as set forth in Example I. Even under severe conditions, such as 380° F. for 10 minutes at 1,000 psi, very poor penetration of the color into the tile was observed.

Unfortunately, the transfer paper was difficult to release from the tile. A preferred method of providing a tile substrate with a through-color image according to the present invention is illustrated in the following two examples.

EXAMPLE XVII

Example XVII illustrates the simultaneous application and transfer printing of a polyvinyl chloride wear layer to the tile base of Example XVI. A 4-mil plastisol layer was applied to the transfer sheet which had been rotogravure printed with a Basic Yellow 13 ink composition as set forth in Example XV. The plastisol was gelled at 250° F. for 3 minutes and then interfaced with a tile substrate as set forth in Example XVI. The interfaced composite materials were then subjected to 10 psi pressure at 320° F. for 60 seconds, after which the transfer paper was separated from the plastisol. A tile having a through-color fused wear layer was produced.

EXAMPLE XVIII

This example illustrates the interfacing of a tile base, a vinyl film and a transfer paper printed with a design to produce a tile having a through-color wear layer. A tile base as set forth in Example XVI was interfaced with a 4-mil, commercially available vinyl film containing about 20% butyl benzyl phthalate plasticizer. The exposed surface of the vinyl film was then interfaced with an image carried by a transfer paper prepared as described in Examples I–IV, the image on the transfer paper having been rotogravure printed using an ink composition as set forth in Example XV. The interfaced materials were subjected to a temperature of 300° F. and a pressure of 10 psi for 1 minute. After separating the transfer paper, the tile had a fused, through-color vinyl wear layer.

EXAMPLE XIX

This example illustrates the use of a powder dispersion technique to image a transfer sheet, after which the dye is migrated into a substrate. A powdered image composition comprising 46% polyvinyl butyral binder, 3% Basic Blue 26 dye and 51% inorganic material was randomly sprinkled on the surface of a piece of Frankote paper prepared as described in Examples I–IV. The transfer sheet was warmed to 300° F. to tack the image composition to the surface of the sheet. The imaged transfer sheet was then interfaced with a backed fused plastisol and heated under about 10 pounds pressure for 30 seconds at 300° F. The transfer sheet was separated and the image composition was removed with the transfer sheet. The resulting dyed substrate had a through-color image corresponding to the random distribution of the image composition.

The present invention is not limited solely to the descriptions and illustrations provided above, but encompasses all modifications encompassed by the following claims.

What is claimed is:

1. A process for preparing a decorative sheet comprising polyvinyl chloride and a substantially non-migratable image, said process comprising the steps of selecting a substrate comprising polyvinyl chloride, interfacing an image composition with said substrate, said image composition comprising at least one cationic dyestuff and a binder, and heating said interfaced substrate and image composition to migrate said dyestuff into said substrate, said binder being of a type which will not substantially impede migration of said dyestuff.

2. The invention as set forth in claim 1 hereof wherein migration is achieved by heating at from about 180° to about 380° F. for from about 1 to about 300 seconds.

3. The invention as set forth in claim 1 hereof wherein migration is achieved by heating at from about 270° to about 350° F. for from about 1 to about 100 seconds.

4. The invention as set forth in claims 1, 2 or 3 hereof wherein a pressure of from 0 to about 500 psi is applied during migration.

5. The invention as set forth in claim 4 hereof wherein said pressure is from about 10 to about 50 psi.

6. The invention as set forth in claims 1, 2 or 3 hereof wherein said binder comprises at least one polyvinyl acetal, cellulose ether or mixture thereof.

7. The invention as set forth in claim 6 hereof wherein said binder is selected from the group consisting of polyvinyl butyral, ethyl cellulose and methyl cellulose.

8. The invention as set forth in claims 1, 2 or 3 hereof wherein said dyestuff has a relatively delocalized ionic charge.

9. The invention as set forth in claims 1, 2 or 3 hereof wherein said substrate is directly imaged with said image composition.

10. The invention as set forth in claim 9 hereof wherein imaging is accomplished using a printing process.

11. The invention as set forth in claim 9 hereof wherein imaging is accomplished using a hand application technique.

12. The invention as set forth in claim 9 hereof wherein imaging is accomplished using powder dispersion.

13. The invention as set forth in claims 1, 2 or 3 hereof wherein said image composition is provided by transfer printing said substrate.

14. The invention as set forth in claim 13 hereof comprising the steps of imaging said transfer sheet with said image composition, interfacing the imaged transfer sheet with said substrate such that said image composition is substantially in contact with said substrate, and separating said transfer sheet from said substrate after migration of said dyestuff is complete.

15. The invention as set forth in claim 14 hereof wherein imaging is accomplished using a process.

16. The invention as set forth in claim 14 hereof wherein imaging is accomplished using a hand application technique.

17. The invention as set forth in claim 14 hereof wherein imaging is accomplished using powder dispersion.

18. The invention as set forth in claim 14 hereof wherein said image composition remains on said transfer sheet after separation.

19. The invention as set forth in claim 14 hereof wherein said transfer sheet comprises a clay-coated kraft paper coated with a material that facilitates release of said transfer sheet from said substrate.

20. The invention as set forth in claim 19 hereof wherein said material that facilitates release is selected from the group consisting of polyvinyl alcohol, ethyl cellulose, methyl cellulose or mixtures thereof.

21. The invention as set forth in claim 14 hereof wherein said transfer sheet comprises a foil.

22. The invention as set forth in claim 14 hereof wherein said transfer sheet comprises a polyester film.

23. The invention as set forth in claims 1, 2 or 3 hereof wherein said substrate is interfaced with a support surface that has been imaged with said image composition.

24. The invention as set forth in claim 23 hereof wherein imaging is accomplished using a printing process.

25. The invention as set forth in claim 23 hereof wherein imaging is accomplished using a hand application technique.

26. The invention as set forth in claim 23 hereof wherein imaging is accomplished using powder dispersion.

27. A decorative sheet comprising polyvinyl chloride and a substantially non-migratable image comprising at least one cationic dyestuff.

28. The invention as set forth in claim 27 hereof, said sheet being obtained by interfacing an image composition with a substrate comprising polyvinyl chloride, said image composition comprising at least one cationic dyestuff and a binder, and heating said interfaced substrate and image composition to migrate said dyestuff into said substrate, said binder being of a type which will not substantially impede migration of said dyestuff.

29. The invention as set forth in claim 28 hereof wherein said sheet comprises a polyvinyl chloride homopolymer.

30. The invention as set forth in claim 28 hereof wherein said sheet comprises a copolymer of vinyl chloride.

31. The invention as set forth in claim 30 hereof wherein said vinyl chloride is copolymerized with at least one compound selected from the group consisting of vinylidene chloride, vinyl acetate and acrylic acid.

32. The invention as set forth in claims 27, 28, 29, 30 or 31 hereof wherein said sheet comprises a substantially through-color image.

33. The invention as set forth in claim 32 hereof wherein said sheet is a floor covering comprising a backing material.

34. The invention as set forth in claims 27, 28, 29, 30 or 31 hereof wherein said sheet comprises a plurality of substantially through-color layers, said sheet demonstrating a substantially three-dimensional appearance.

35. The invention as set forth in claim 34 hereof wherein said sheet is a floor covering comprising a backing material.

36. A decorative floor covering, said covering comprising a backing, and a substrate comprising polyvinyl chloride adhered to said backing, said substrate comprising a substantially non-migratable image comprising at least one cationic dyestuff.

37. The invention as set forth in claim 36, hereof wherein said substrate comprises a substantially through-color image.

38. The invention as set forth in claim 36 hereof wherein said substrate comprises a plurality of layers comprising through-color images.

39. The invention as set forth in claim 38 hereof wherein said substrate has a three-dimensional appearance.

40. The invention as set forth in claims 36, 37, 38 or 39 hereof wherein said floor covering is a sheet flooring.

41. The invention as set forth in claim 40 wherein said sheet flooring comprises a through-color wear layer.

42. The invention as set forth in claims 36, 37, 38 or 39 hereof wherein said floor covering is a floor tile.

43. The invention as set forth in claim 42 hereof wherein said floor tile has a through-color wear layer.

44. A composite adaptable to provide a polyvinyl chloride-containing substrate comprising a substantially non-migratable through-color image, said composite comprising an image composition interfaced with a substrate comprising polyvinyl chloride, said image composition consisting essentially of at least one cationic dyestuff and a binder which will not substantially impede migration of said dyestuff.

45. The invention as set forth in claim 44 hereof wherein said dyestuff has a delocalized ionic charge.

46. The invention as set forth in claim 44 hereof wherein said binder comprises at least one polyvinyl acetal, cellulose ether or mixture thereof.

47. The invention as set forth in claim 46 hereof wherein said binder is selected from the group consisting of polyvinyl butyral, methyl cellulose and ethyl cellulose.

* * * * *